US010102800B2

(12) United States Patent
Jeong

(10) Patent No.: US 10,102,800 B2
(45) Date of Patent: Oct. 16, 2018

(54) ORGANIC LIGHT EMITTING DISPLAY DEVICE

(71) Applicant: SAMSUNG DISPLAY CO., LTD., Yongin, Gyeonggi-Do (KR)

(72) Inventor: Jin-Tae Jeong, Yongin (KR)

(73) Assignee: Samsung Display Co., Ltd., Yongin, Gyeonggi-do (KR)

( * ) Notice: Subject to any disclaimer, the term of this patent is extended or adjusted under 35 U.S.C. 154(b) by 382 days.

(21) Appl. No.: 14/737,644

(22) Filed: Jun. 12, 2015

(65) Prior Publication Data

US 2016/0111043 A1 Apr. 21, 2016

(30) Foreign Application Priority Data

Oct. 21, 2014 (KR) ..... 10-2014-0142820

(51) Int. Cl.
*G09G 3/3233* (2016.01)

(52) U.S. Cl.
CPC ... *G09G 3/3233* (2013.01); *G09G 2300/0814* (2013.01); *G09G 2300/0819* (2013.01); *G09G 2330/08* (2013.01)

(58) Field of Classification Search
CPC ..... G09G 3/3233
See application file for complete search history.

(56) References Cited

U.S. PATENT DOCUMENTS

| | | | | |
|---|---|---|---|---|
| 6,888,589 | B2 | 5/2005 | Kim et al. | |
| 8,710,748 | B2 * | 4/2014 | Iketsu | H01L 27/3204 315/161 |
| 2010/0141646 | A1 * | 6/2010 | Tanabe | G09G 3/2022 345/214 |
| 2011/0075072 | A1 * | 3/2011 | Kim | G09G 3/3426 349/69 |
| 2013/0300725 | A1 | 11/2013 | Jeong | |

FOREIGN PATENT DOCUMENTS

| | | |
|---|---|---|
| KR | 1997-0028986 | 6/1997 |
| KR | 10-2010-0116806 A | 11/2010 |
| KR | 10-2011-0068159 A | 6/2011 |
| KR | 10-2013-0126006 | 11/2013 |

* cited by examiner

*Primary Examiner* — Nelson Rosario
*Assistant Examiner* — Scott Au
(74) *Attorney, Agent, or Firm* — Lee & Morse, P.C.

(57) ABSTRACT

An organic light emitting display device includes pixel driving circuits to control pixels which include organic light emitting diodes. The pixel driving circuits include a first pixel driving circuit and a second pixel driving circuit, and the organic light emitting diodes include a first organic light emitting diode. The first organic light emitting diode emits light at a first brightness based on a driving current from the first pixel driving circuit in a first frame, and emits light at a second brightness based on a driving current from the second pixel driving circuit in a second frame.

17 Claims, 6 Drawing Sheets

ORGANIC LIGHT EMITTING DISPLAY DEVICE

CROSS-REFERENCE TO RELATED APPLICATION

Korean Patent Application No. 10-2014-0142820, filed on Oct. 21, 2014, and entitled, "Organic Light Emitting Display Device," is incorporated by reference herein in its entirety.

BACKGROUND

1. Field

One or more embodiments herein relate to an organic light emitting display device.

2. Description of the Related Art

A variety of displays have been developed. Examples include a liquid crystal displays, plasma display panels, and organic light emitting displays. Of these, an organic light emitting display includes scan lines for applying a scan signal is applied, data lines that intersect the scan lines, pixel driving circuits, and organic light emitting diodes. The organic light emitting diodes emit light to generate an image.

SUMMARY

In accordance with one embodiment, an organic light emitting display device includes scan lines in a first direction; data lines in a second direction; pixel driving circuits connected to the scan lines and the data lines, each of the pixel driving circuits to output a driving current; and organic light emitting diodes to emit light based on corresponding ones of the driving currents, wherein: the pixel driving circuits include a first pixel driving circuit and a second pixel driving circuit, and the organic light emitting diodes include a first organic light emitting diode, the first organic light emitting diode to emit light at a first brightness based on a driving current from the first pixel driving circuit in a first frame, and to emit light at a second brightness based on a driving current from the second pixel driving circuit in a second frame.

The display device may include switches to control an electrical connection state of the driving circuits and the organic light emitting diodes. The switches may include a first switch between the first organic light emitting diode and the first pixel driving circuit, and a second switch between the first organic light emitting diode and the second pixel driving circuit. In the first frame, the first switch may be turned on and the second switch is to be turned off. In the second frame, the first switch may be turned off and the second switch is to be turned on.

The first organic light emitting diode may not to emit light in the first frame and may emit light at a third brightness in the second frame when the first pixel driving circuit operating abnormally, and the third brightness may be greater than the second brightness. The third brightness may be twice or more than the second brightness.

The display device may include a driver to apply scan signals and data voltages to each of the scan lines and the data lines, wherein the driver may change a level of a data voltage to be applied to the second pixel driving circuit of the data voltages when the first pixel driving circuit is operating abnormally. The first switch may be turned off in the first frame and the second frame when the first pixel driving circuit is operating abnormally.

The first pixel driving circuit and the second pixel driving circuit may be connected to a same scan line and are adjacent to each other in the first direction. Each row of the organic light emitting diodes may include n number of organic light emitting diodes (n being a positive integer), the number of the data lines being n+1.

The first pixel driving circuit and the second pixel driving circuit may be connected to a same data line and are adjacent to each other in the second direction. Each column of the organic light emitting diodes may include m number of organic light emitting diodes (m being a positive integer), the number of the scan lines being m+1. The first switch and the second switch may be turned on alternately.

In accordance with another embodiment, a display device includes a first pixel driving circuit; a second pixel driving circuit; an organic light emitting diode to emit light at a first brightness based on a driving current from the first pixel driving circuit in a first frame and to emit light at a second brightness based on a driving current from the second pixel driving circuit in a second frame, wherein the first brightness is different from the second brightness.

The display device may include a first switch between the organic light emitting diode and the first pixel driving circuit; and a second switch between the organic light emitting diode and the second pixel driving circuit, wherein: in the first frame, the first switch is to be in a first state and the second switch is to be in a second state, and in the second frame, the first switch is to be in the second state and the second switch is to be in the first state. The first switch may be turned off in the first frame and the second frame when the first pixel driving circuit is operating abnormally.

The first organic light emitting diode may not emit light in the first frame and may emit light at a third brightness in the second frame when the first pixel driving circuit operating abnormally, the third brightness is greater than the second brightness. The third brightness may be twice or more than the second brightness.

The display device may include a driver to change a level of a data voltage to be applied to the second pixel driving circuit when the first pixel driving circuit is operating abnormally. The first pixel driving circuit and the second pixel driving circuit may be connected to a same scan line and are adjacent to each other.

In accordance with another embodiment, a driver includes an interface; and a control circuit coupled to output a first control signal and a second control signal through the interface, wherein: the first control signal is to connect a light emitter to a first pixel circuit and the second control signal is to disconnect the light emitter from a second pixel circuit in a first frame, when the first pixel circuit and the second pixel circuit are in a non-defective state, the first control signal is to disconnect the light emitter from the first pixel circuit and the second control signal is to connect the light emitter from the second pixel circuit in a second frame, when the first pixel circuit and the second pixel circuit are in the non-defective state, the first control signal is to disconnect the light emitter from the first pixel circuit and the second control signal is to disconnect the second pixel circuit from the light emitter in the first frame, when the first pixel circuit is in a defective state and the second pixel circuit is in the non-defective state, and the first control signal is to disconnect the light emitter from the first pixel circuit and the second control signal is to connect the light emitter to the second pixel circuit in the second frame, when the first pixel circuit is in the defective state and the second pixel circuit is in the non-defective state, wherein the control circuit is to output the second control signal in the second frame during a period when the second pixel circuit is to receive a first data voltage, when the first pixel circuit and the second pixel circuit are in the non-defective state, and wherein the control circuit is to output the second control signal in the second frame during a period when second pixel circuit is to receive a second data voltage different from the first data voltage, when the first pixel circuit is in the defective state and the second pixel circuit is in the non-defective state

BRIEF DESCRIPTION OF THE DRAWINGS

Features will become apparent to those of skill in the art by describing in detail exemplary embodiments with reference to the attached drawings in which.

DETAILED DESCRIPTION

Figure 1:
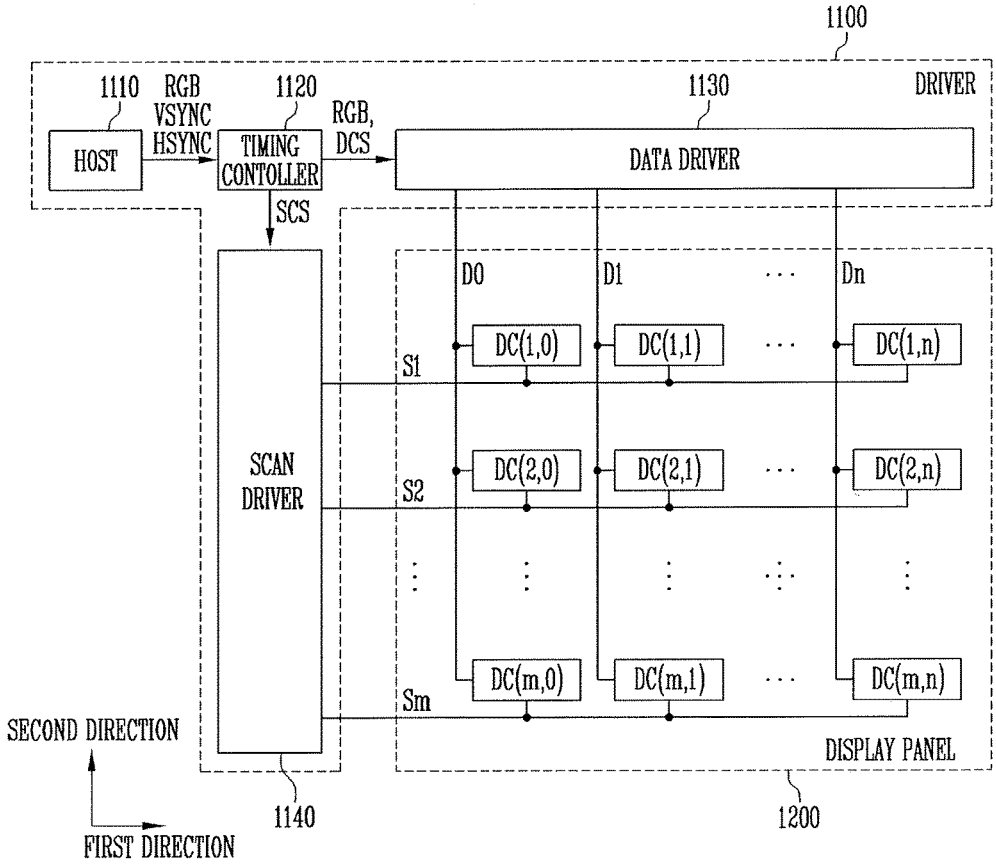
FIG. 1 illustrates an embodiment of an organic light emitting display device.

Example embodiments are described more fully hereinafter with reference to the accompanying drawings; however, they may be embodied in different forms and should not be construed as limited to the embodiments set forth herein. Rather, these embodiments are provided so that this disclosure will be thorough and complete, and will fully convey exemplary implementations to those skilled in the art. In the drawings, the dimensions of layers and regions may be exaggerated for clarity of illustration. Like reference numerals refer to like elements throughout.

Also, in this specification, the terms "connected" and "coupled" refer to one component that may not be only directly connected or coupled to another component, but also which is indirectly connected or coupled to another component, for example, through an intermediate component. On the other hand, "directly connected/directly coupled" refers to one component directly coupling another component without an intermediate component.

Figure 2:
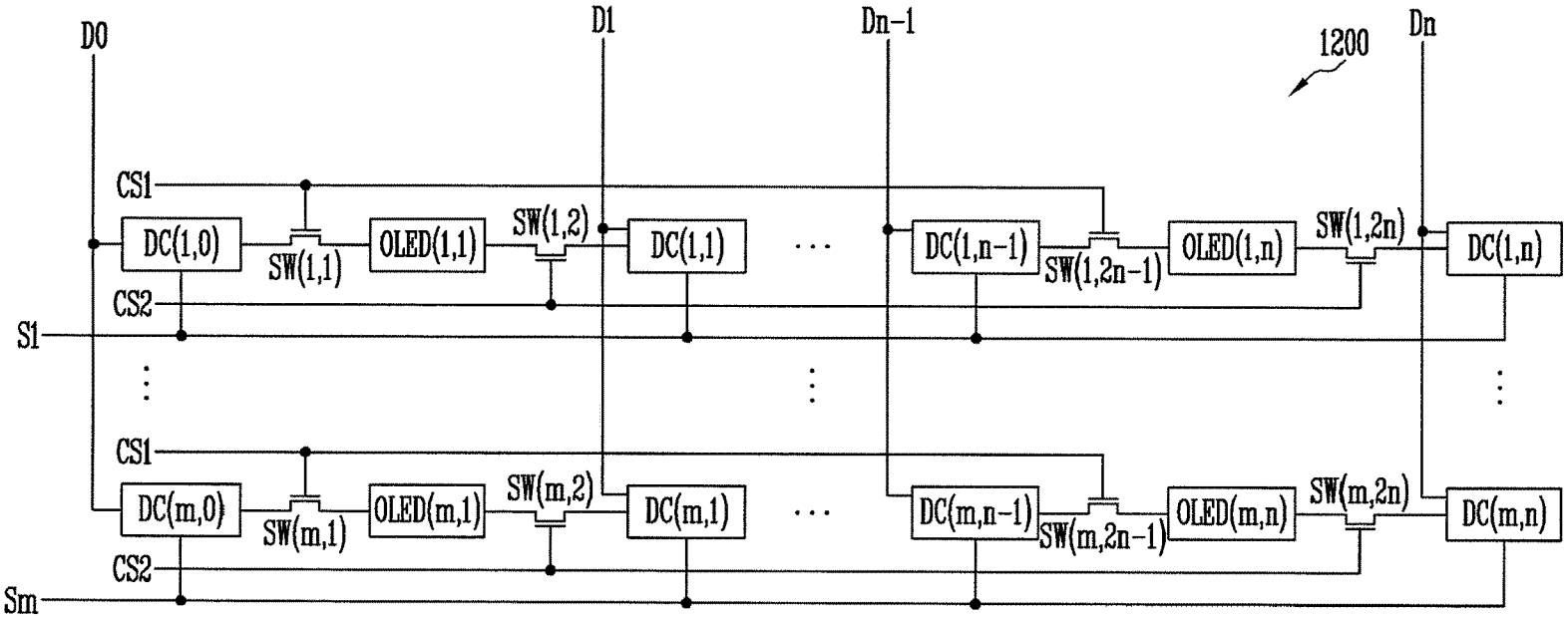
FIG. 2 illustrates examples of pixel driving circuits, organic light emitting diodes, and switches in the display device of FIG. 1.

FIG. 1 illustrates one embodiment of an organic light emitting display device, and FIG. 2 illustrates an example of pixel driving circuits, organic light emitting diodes, and switches in the display device of FIG. 1.

Referring to FIG. 1, the organic light emitting display device includes a driver 1100 and a display panel 1200. The driver 1100 includes a host 1110, timing controller 1120. data driver 1130, and scan driver 1140. The display device also includes organic light emitting diodes and switches. In another embodiment, at least one of the host 1110 or the timing controller 1120 may be external to the driver 1100.

The host 1110 receives one or more electric signals from an external source and provides the electric signal(s) to the timing controller 1120. The host 1110 provides image data (RGB), vertical sync signal (Vsync), and horizontal sync signal (Hsync) input from an external video source device (including, for example, a system-on-chip including a scaler is mounted) to the timing controller 1120. These and/or other signals (for example, data enable signals, dot clocks, etc.) may also be provided to the timing controller 1120.

The timing controller 1120 receives timing signals (e.g., Vsync, Hsync) from the host 1110 and generates timing control signals for controlling operating timing of the data driver 1130 and the scan driver 1140. The timing control signals include scan timing control signals (SCS) for controlling operating timing of the scan driver 1140, and data timing control signals (DCS) for controlling operating timing of the data driver 1130 and a data voltage. Furthermore, the timing controller 1120 outputs image data (RGB) to the data driver 1130 so that the display panel 1200 may display an image.

The data driver 1130 latches the image data (RGB) input from the timing controller 1130 in response to the data timing control signals (DCS). The data driver 1130 includes a plurality of source driver ICs. The source drive ICs may be electrically connected to n+1 number of data lines (D0 to Dn, n being a positive integer) of the display panel 1200 by various processes. In one embodiment, the data driver 1130 may apply data voltages to data lines (D0 to Dn−1) in a first frame and may apply data voltages to data lines (D1 to Dn) in a second frame.

The scan driver 1140 sequentially applies a scan signal to scan lines (S1 to Sm, m being a positive integer) in response to the scan timing control signal (SCS) at every frame, and especially in the first frame and the second frame. The scan driver 1140 may be electrically connected to the scan lines (S1 to Sm) of the display panel 1200 by various processes.

Referring to FIG. 2 again, the display panel 1200 includes the scan lines (S1 to Sm), data lines (D0 to Dn), pixel driving circuits (DC(1,0) to DC(m,n)) and organic light emitting diodes (OLED(1,1) to OLED(m,n)). The pixel driving circuits (DC(m,n)) may receive the data voltages applied to the data line (Dn) at a timing where a scan signal is applied to the scan line (Sm) and may output a driving current. The level of the driving current is determined based on the level of the data voltage applied to the data line (Dn). Each of the organic light emitting diodes may be adjacent to another organic light emitting diode in a first direction or second direction. In the embodiment of FIGS. 1 and 2, the organic light emitting diodes (OLED(1,1) to OLE(m,n)) are arranged in a matrix format having m rows and n columns. Each of the rows includes n number of organic light emitting diodes, and the number of data lines (D0 to Dn) is n+1.

Referring to FIG. 2, the display panel 1200 includes pixel driving circuits (DC(1,0) to DC(m,n)), organic light emitting diodes (OLED(1,1) to OLED(m,n)) and switches (SW(1,1) to SW(m,2n)). Each of the organic light emitting diodes may be electrically connected to two pixel driving circuits, and may receive a driving current from one of the two pixel driving circuits. (Hereinafter, for convenience of explanation, organic light emitting diode (OLED(1,1)) will be explained).

The organic light emitting diode (OLED(1,1)) may be electrically connected to the pixel driving circuit (DC(1,0)) through the switch (SW(1,1)), and may be electrically connected to the pixel driving circuit (DC,(1,1)) through the switch (SW(1,2)). The switches (SW(1,1), SW(1,2)) may be, for example, P-type or N-type transistors. The switch (Sw (1,1)) is turned on only when a first control signal (CS1) is applied to its gate. The switch (SW(1,2)) is turned on only when a second control signal (CS2) is applied to its gate. The first and second control signals CS1 and CS2 may be applied from the driver 1100 through one or more appropriate interfaces, e.g., chip ports, signal lines, etc.

In the first frame, the first control signal (CS1) is applied to the gate of the switch (SW(1,1)) and the second control signal (CS2) is not applied to the gate of the switch (SW(1,2)). Thus, the switch (SW(1,1)) is turned on and the switch (SW(1,2)) is turned off. Therefore, the organic light emitting diode (OLED(1,1)) emits light based on the driving current output from the pixel driving circuit (DC(1,0)).

In the second frame, the second control signal (CS2) is applied to the gate of the switch (SW(1,2)) and the first control signal (CS1) is not applied to the gate of the switch (SW(1,1)). Thus, the switch (SW(1,1)) is turned off and the switch (SW(1,2)) is turned on. Therefore, the organic light emitting diode (OLED(1,1)) emits light based on the driving current output from the pixel driving circuit (DC(1,1)).

The pixel driving circuit (DC(1,0)) and pixel driving circuit (DC(1,1)), that output driving current to the organic light emitting diode (OLED(1,1)), may be connected to a same scan line and may be arranged adjacent to each other in a first direction. The organic light emitting diodes (OLED (1,1) to OLED(m,n)) may be electrically connected to each of the pixel driving circuits (DC(1,0) to DC(m,n−1)) in the first frame, and may each be electrically connected to the pixel driving circuits (DC(1,1) to DC(m,n)) in the second frame. The data driver 1130 may apply data voltages to the datalines (D0 to Dn−1) in the first frame, and may apply data voltages to the datalines (D1 to Dn) in the second frame.

Figure 3:
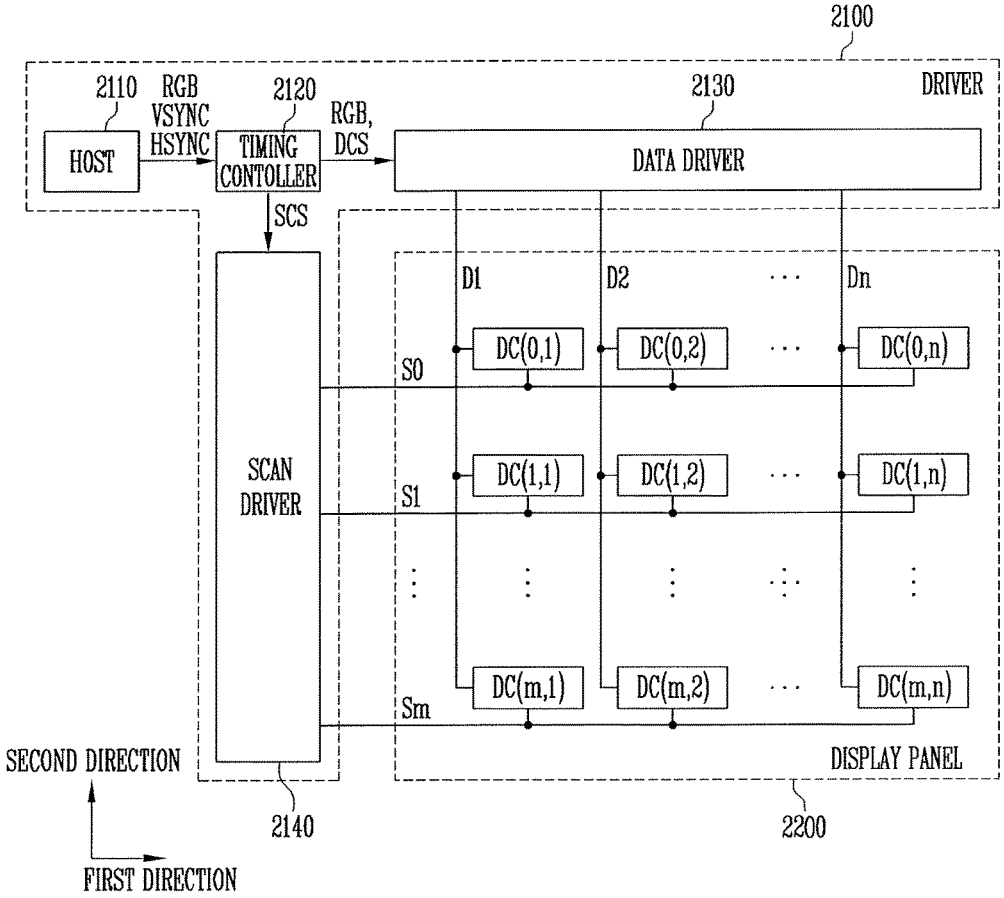
FIG. 3 illustrates another embodiment of an organic light emitting display device.
Figure 4:
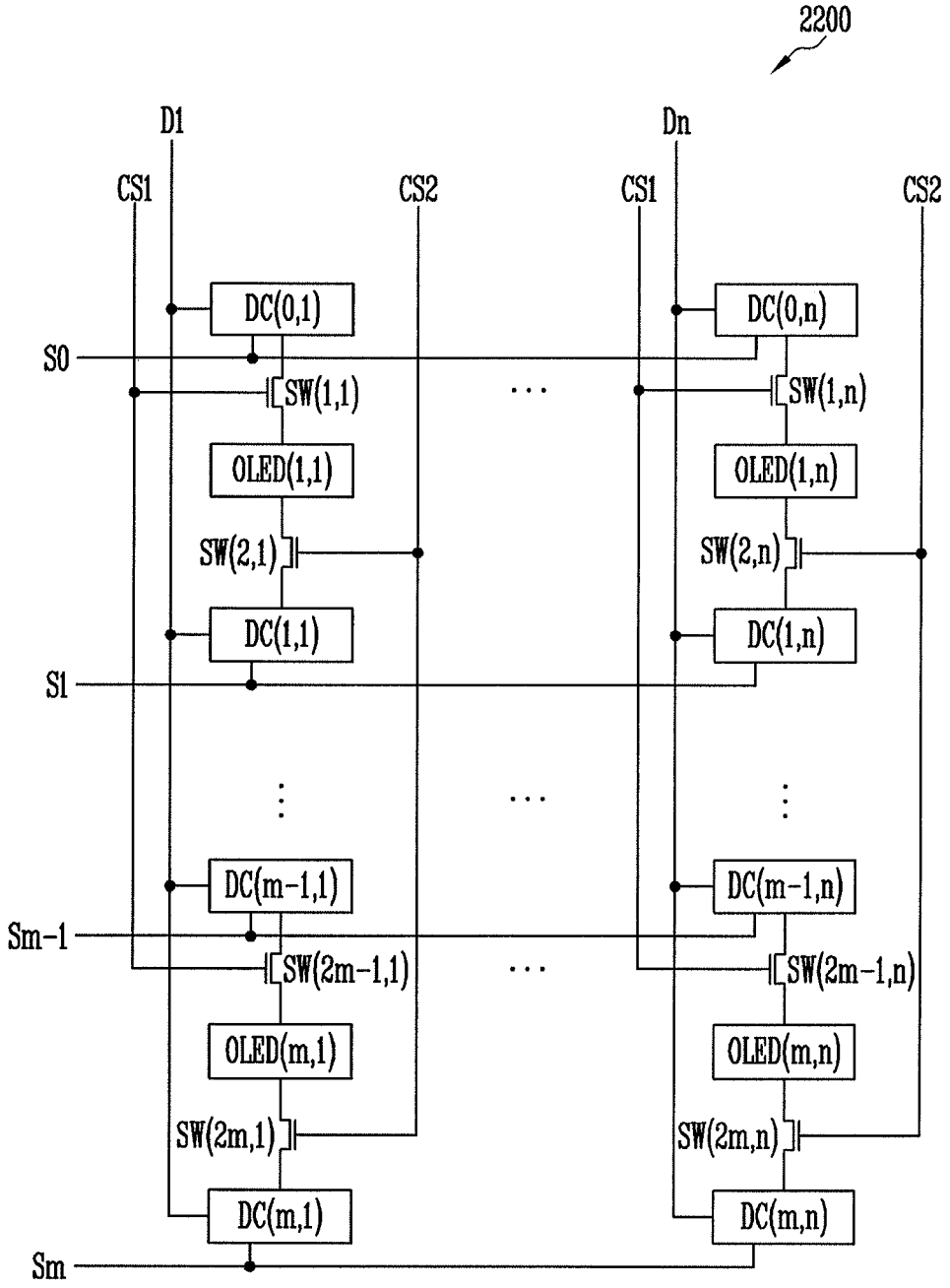
FIG. 4 illustrates examples of pixel driving circuits, organic light emitting diodes, and switches in the display device of FIG. 3.

FIG. 3 illustrates another embodiment of an organic light emitting display device, and FIG. 4 illustrates examples of pixel driving circuits, organic light emitting diodes, and switches in the display device of FIG. 3.

Referring to FIG. 3, the organic light emitting display device includes a driver 2100 and display panel 2200. The driver 2100 includes a host 2110, timing controller 2120, data driver 2130, and scan driver 2140. The host 2110 and timing controller 2120 may be the same as the host 1110 and timing controller 1120. The data driver 1230 may apply a data voltage to n number of data lines (D1 to Dn). The scan driver 2140 may apply a scan signal to m+1 number of scan lines (S0 to Sm). The data driver 1230 may sequentially apply a scan signal to scan lines (S0 to Sm−1) in the first frame, and may sequentially apply a scan signal to scan lines (S1 to Sm). In another embodiment, at least one of the host 2110 or the timing controller 2120 may be external to the driver 2100.

The display panel 2200 includes scan lines (S0 to Sm), data lines (D1 to Dn), pixel driving circuits (DC(0,1) to DC(m,n)), and organic light emitting diodes (OLED(1,1) to OLED(m,n)). The pixel driving circuit (DC(m,n)) may operation in the same manner as in FIG. 1.

Each of the organic light emitting diodes are adjacent to another organic light emitting diode in the first direction or second direction. In the embodiment of FIGS. 3 and 4, the organic light emitting diodes (OLED(1,1) to OLED(m,n)) may be arranged in a matrix format having m rows and n columns. Each of the columns includes m number of organic light emitting diodes, and the number of scan lines (S0 to Sm) are m+1.

Referring to FIG. 4, the display panel 2200 includes pixel driving circuits (DC(0,1) to DC(m,n)), organic light emitting diodes (OLED(1,1) to OLEd(m,n)), and switches (SW(1,1) to SW(2m,n)). A number n of organic light emitting diodes (OLED(1,1) to OLED(m,n)) are arranged in the first direction, and m number of organic light emitting diodes (OLED (1,1) to OLED(m,n)) are arranged in the second direction. (Hereinafter, for convenience of explanation, the organic light emitting diode (OLED(1,1)) will be explained).

The organic light emitting diode OLEd(1,1)) may be electrically connected to the pixel driving circuit (DC(0,1)) through the switch (SW(1,1)), and may be electrically connected to the pixel driving circuit (DC(1,1)) through the switch(SW(2,1)). The switches (SW(1,1), SW(2,1)) may be, for example, P-type or N-type transistors. The switch (SW (1,1)) is turned on only when the first control signal (CS1) is applied to its gate. The switch (SW(2,1)) is turned on only when the second control signal (CS2) is applied to its gate.

In the first frame, the first control signal (CS1) is applied and the second control signal (CS2) is not applied. Thus, the switch (SW(1,1)) is turned on and the switch (SW(2,1)) is turned off. Therefore, the organic light emitting diode (OLED(1,1)) emits light based on the driving current output from the pixel driving circuit (DC(0,1)).

In the second frame, the second control signal (CS2) is applied and the first control signal (CS1) is not applied. Thus, the switch (SW(1,1)) is turned off and the switch (SW(2,1)) is turned on. Therefore, the organic light emitting diode (OLED(1,1)) emits light based on the driving current output from the pixel driving circuit (DC(1,1)). The pixel driving circuit (DC(0,1)) and pixel driving circuit (DC(1,1)), that may output the driving current to the organic light emitting diode (OLED(1,1)), may be connected to a same data line and may be arranged adjacent to each other in the second direction.

The organic light emitting diodes (OLED(1,1) to OLED (m,n)) may be electrically connected to each of the pixel driving circuit (DC(0,1) to Dc(m−1,n) in the first frame, and may be electrically connected to each of the pixel driving circuits (DC(1,1) to DC(m,n)) in the second frame. The scan driver (1140) may apply the scan signals to the scan lines (S0 to Sm−1) in the first frame, and may apply the scan signals to the scan lines (S1 to Sm) in the second frame.

Figure 5A:
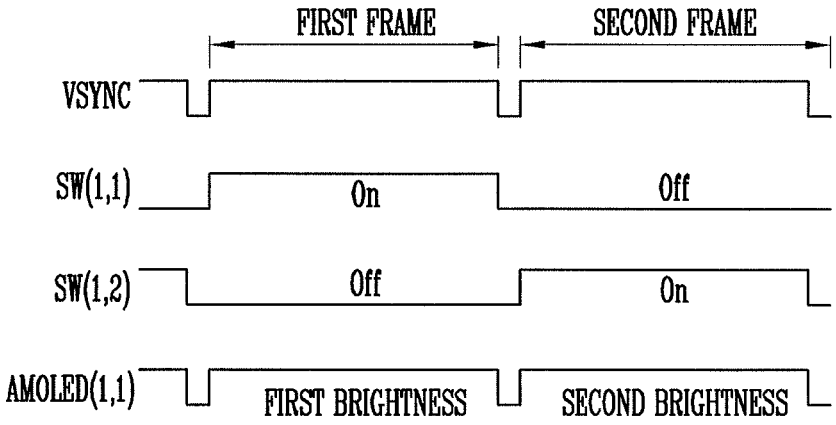
FIG. 5A illustrates an example where a first pixel driving circuit and a second pixel driving circuit operate normally.

FIG. 5A illustrates an example of the operation of the first switch, second switch, and first organic light emitting diode when the first pixel driving circuit and second pixel driving circuit operate normally, for example, in the display device of FIG. 1. For convenience of explanation, it is assumed that the first pixel driving circuit is the pixel driving circuit (DC(1,0)), the second pixel driving circuit is the pixel driving circuit (DC(1,1)), the first switch is the switch(SW (1,1)), and the second switch is the switch (SW(1,2)), and the first organic light emitting diode is the organic light emitting diode (OLED(1,1)).

Referring to 5A, in the first frame, the switch (SW(1,1)) is turned on and the switch (SW(1,2)) is turned off. Therefore, the organic light emitting diode (OLED(1,1)) may emit light at a first brightness based on the driving current output from the pixel driving circuit (DC(1,0)). In the second frame, the switch (SW(1,1)) is turned off and the switch (SW(1,2)) is turned on. Therefore, the organic light emitting diode (OLED(1,1)) may emit light at a second brightness based on the driving current output from the pixel driving circuit (DC(1,1)).

When the switch (SW(1,1)) and the switch (SW(1,2)) are turned on at the same time, the pixel driving circuit (DC(1,0) and DC(1,1)) may be damaged. In order to prevent the pixel driving circuit (DC(1,0) and DC(1,1)) from being damaged, after a time has passed since the switch (SW(1,1)) is turned off from a turned on state, the switch (SW(1,2)) may be turned on from a turned off state.

Figure 5B:
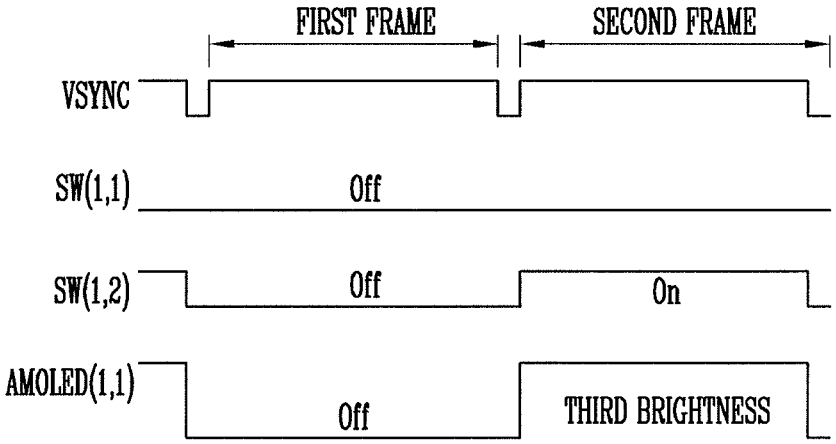
FIG. 5B illustrates an example where the first driving circuit operates abnormally and the second pixel driving circuit operates normally.

FIG. 5B illustrates an example of the operation of the first switch, second switch, and first organic light emitting diode when the first pixel driving circuit operations abnormally and the second pixel driving circuit operates normally, for example, in the display device of FIG. 1.

Abnormal operation of a pixel driving circuit may correspond, for example, to when the pixel driving circuit receives a data voltage but current is not output, or when a level of the output current is distorted and thus the organic light emitting diode electrically connected does not emit light of a desired brightness.

The switch arranged between the pixel driving circuit and the organic light emitting diode may maintain an off state. For convenience of explanation, it is assumed that the first pixel driving circuit is the pixel driving circuit (DC(1,0)), the second pixel driving circuit is the pixel driving circuit (DC(1,1)), the first switch is the switch (SW(1,1)), the second switch is the switch (SW(1,2)), and the first organic light emitting diode is the organic light emitting diode (OLED(1,1)).

Referring to FIG. 5B, since the switch (SW(1,1)) is kept turned off, the abnormally operating pixel driving circuit (DC(1,0)) is not electrically connected to the organic light emitting diode (OLED(1,1)). Furthermore, since the switch (SW(1,2)) is turned off, the driving current is not applied to the organic light emitting diode (OLED(1,1)) in the first frame, and thus light is not emitted.

In the second frame, the switch (SW(1,1)) is kept turned off, but the switch (SW(1,2)) is turned on, and thus the organic light emitting diode (OLED(1,1)) is electrically connected to the pixel driving circuit (DC(1,1)). When the pixel driving circuit (DC(1,0)) operates abnormally, the data driver 1130 of the driver 1100 may change the data voltage (e.g., data voltage applied to the data line (D1)) applied to the pixel driving circuit (DC(1,1)) so that light is emitted in the second frame. In one embodiment, the third brightness may be greater (e.g., twice or more) than the second brightness.

In one embodiment, the relative location of the organic light emitting diode (OLED(1,1)) inside the organic light emitting diodes (OLED(1,1 to OLED(m,n)) may have no relation to the frame. Also, since the difference in timing between the timing of emitting light in the first brightness and the timing of emitting light in the second brightness is 1 frame, it is possible to assume that the difference of the level between the first brightness and the second brightness is sufficiently small.

Therefore, emitting light at the first brightness in the first frame while emitting light at the second brightness in the second frame, and not emitting light in the first frame while emitting light at the third brightness in the second frame, may have very similar average values of the brightness. These differences, therefore may not be easily differentiated by the naked eye.

To explain the changes in the data voltage (e.g., data voltage being applied to the data line (D1)), it is assumed that the driving current is proportional to the square of the data voltage. When the third brightness is set to "a" times (a being a positive real number) the second brightness, the level of the data voltage applied to the pixel driving circuit (DC(1,1)) may change based on the following equation.

$$V\text{data}(1,1)' = \sqrt{a} \times V\text{data}(1,1)$$

When the (Vdata(1,1)': pixel driving circuit (DC(1,0)) operates abnormally, the data voltage is applied to the pixel driving circuit (DC(1,1)). When the Vdata(1,1): pixel driving circuit (DC(1,0)) operates normally, the data voltage is applied to the pixel driving circuit (DC(1,1)). Thus, because the level of the data voltage is changed, the level of the driving current output from the pixel driving circuit (DC(1,1)) may increase. for example, by twice or more.

Figure 6:
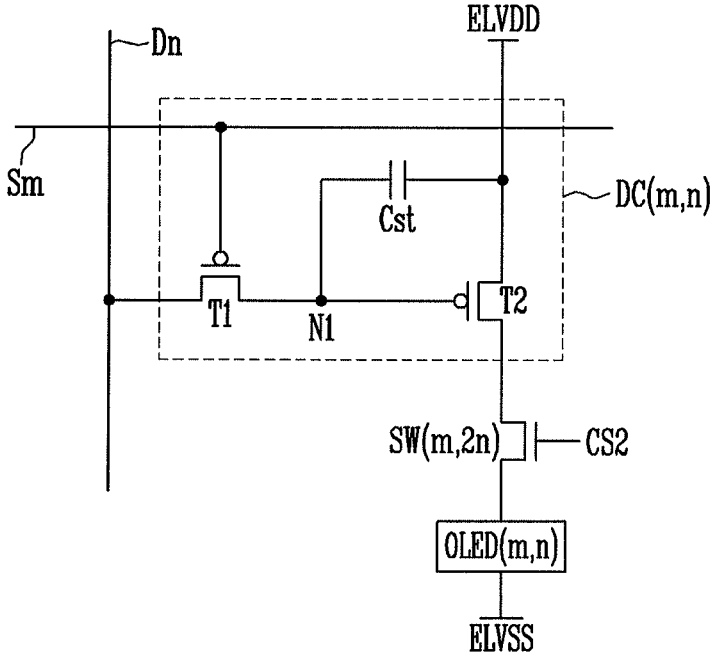
FIG. 6 illustrates an embodiment of a pixel driving circuit.

FIG. 6 illustrates an embodiment of a pixel driving circuit, which, for example, may be included in the display device of FIG. 1. For convenience of explanation, the pixel driving circuit (DC(m,n)) of FIG. 1 will be discussed.

Referring to FIG. 6, the pixel driving circuit (DC(m,n)) may be electrically connected to the scan line (Sm) and data line (Dn), and may output the driving current. The organic light emitting diode (OLED(m,n)) may receive the driving current and emit light, where the brightness of the emitted light corresponds to the level of the driving current.

The pixel driving circuit (DC(m,n)) may include a first transistor (T1), second transistor (T2), and storage capacitor (Cst). The gate electrode of the first transistor (T1) is connected to the scan line (Sm), the first electrode is connected to the data line (Dn), and the second electrode is connected to the first node (N1). The first electrode may be an electrode different from the source electrode or drain electrode, and the second electrode may be an electrode different from the first electrode. For example, when the first electrode is a source electrode, the second electrode is a drain electrode.

A gate electrode of the second transistor (T2) is connected to a first node (N1), and to a first electrode, a high potential voltage (ELVDD) is applied. The second electrode is connected to one end of the switch (m,2n).

A high potential voltage (ELVDD) may be applied to one end of the storage capacitor (Ct) and a first node (N1) is connected to the other end of the storage capacitor Ct.

One end of the switch (m, 2n) is connected to the second electrode of the second transistor (T2), and the other end is connected to the anode electrode of the organic light emitting diode (OLED(m,n)). When the second control signal (CS2) is applied to the gate of the switch (m,2n), the switch (m,2n) is turned on. Thus, driving current output from the second electrode of the second transistor T2 may be applied to the organic light emitting diode (OLED(m,n)). When the second control signal (CS2) is not applied to the gate of the switch (m,2n), the switch (m,2n) is turned off, and thus is floated to the second electrode.

The anode electrode of the organic light emitting diode (OLED(m,n)) is connected to the other end of the switch (m,2n), and the to the cathode electrode, a low potential voltage (ELVSS) is applied. Referring again to FIG. 2, the anode electrode of the organic light emitting diode (OLED (m,n)) is connected to the other end of the switch (m,2n−1).

The first transistor (T1) is turned on when a scan signal is supplied from the scan line (Sm). The data voltage is supplied from the data line (Dn) to the storage capacitor (Cst), and thus the storage capacitor (Cst) is charged.

The second transistor (T2) may control the driving current output from the second electrode of the second transistor (T2) in response to the level of the voltage stored in the storage capacitor (Cst). In another embodiment, a pixel driving circuit different from the one in FIG. 6 may be used in the display device.

The methods, processes, and/or operations of the driver and/or control circuits described herein may be performed by code or instructions to be executed by a computer, processor, controller, or other signal processing device. The computer, processor, controller, or other signal processing device may be those described herein or one in addition to the elements described herein. Because the algorithms that form the basis of the methods (or operations of the computer, processor, controller, or other signal processing device) are described in detail, the code or instructions for implementing the operations of the driver and/or control circuits may transform the computer, processor, controller, or other signal processing device into a special-purpose processor for performing the methods described herein.

Also, another embodiment may include a computer-readable medium, e.g., a non-transitory computer-readable medium, for storing the code or instructions described above. The computer-readable medium may be a volatile or non-volatile memory or other storage device, which may be removably or fixedly coupled to the computer, processor, controller, or other signal processing device which is to execute the code or instructions for performing the method embodiments described herein.

By way of summation and review, a defect may occur in the pixel driving circuit during the process of preparing an organic light emitting display device. The presence of defects may deteriorate the yield rate of the organic light emitting display device. In attempt to improve yield rate, when a defect occurs in a pixel driving circuit, a method has been proposed to electrically connect a corresponding organic light emitting diode to to a preliminary (dummy) pixel driving circuit and to operate the preliminary (dummy) pixel driving circuit normally. Laser irradiation was used as the method for the electrical connecting. However, in the case of electrically connecting the preliminary pixel driving circuit with the organic light emitting diode using laser irradiation, the organic light emitting diode or substrate may deteriorate.

In accordance with one or more of the aforementioned embodiments, a pixel driving circuit that is operating abnormally in an organic light emitting device may be repaired by changing the level of a control signal and a data voltage. Therefore, a defective pixel may be repaired without damaging the organic light emitting diode or substrate, and the yield rate may be improved.

Example embodiments have been disclosed herein, and although specific terms are employed, they are used and are to be interpreted in a generic and descriptive sense only and not for purpose of limitation. In some instances, as would be apparent to one of skill in the art as of the filing of the present application, features, characteristics, and/or elements described in connection with a particular embodiment may be used singly or in combination with features, characteristics, and/or elements described in connection with other embodiments unless otherwise indicated. Accordingly, it will be understood by those of skill in the art that various changes in form and details may be made without departing from the spirit and scope of the present invention as set forth in the following claims.

What is claimed is:

1. An organic light emitting display device, comprising:

scan lines in a first direction;

data lines in a second direction intersecting the first direction;

a first number of pixel driving circuits connected to the scan lines and the data lines, each of the pixel driving circuits to output a driving current; and a second number of organic light emitting diodes to emit light based on corresponding ones of the pixel driving currents, wherein the second number is less than the first number and wherein:

the pixel driving circuits include a first pixel driving circuit and a second pixel driving circuit, and the organic light emitting diodes include a first organic light emitting diode, the first organic light emitting diode to emit light at a first brightness based on a driving current from the first pixel driving circuit in a first frame, and to emit light at a second brightness based on a driving current from the second pixel driving circuit in a second frame, wherein the first organic light emitting diode is not to emit light in the first frame and is to emit light at a third brightness in the second frame when the first pixel driving circuit operating abnormally, the third brightness is greater than the second brightness.

2. The display device as claimed in claim 1, further comprising:

switches to control an electrical connection state of the driving circuits and the organic light emitting diodes.

3. The display device as claimed in claim 2, wherein:

the switches include a first switch between the first organic light emitting diode and the first pixel driving circuit, and a second switch between the first organic light emitting diode and the second pixel driving circuit, in the first frame, the first switch is to be turned on and the second switch is to be turned off, and in the second frame, the first switch is to be turned off and the second switch is to be turned on.

4. The display device as claimed in claim 3, wherein the first switch is to be turned off in the first frame and the second frame when the first pixel driving circuit is operating abnormally.

5. The display device as claimed in claim 3, wherein the first switch and the second switch are to be turned on alternately.

6. The display device as claimed in claim 1, wherein the third brightness is twice or more than the second brightness.

7. The display device as claimed in claim 1, further comprising:

a driver to apply scan signals and data voltages to each of the scan lines and the data lines, wherein the driver is to change a level of a data voltage to be applied to the second pixel driving circuit of the data voltages when the first pixel driving circuit is operating abnormally.

8. The display device as claimed in claim 1, wherein the first pixel driving circuit and the second pixel driving circuit are connected to a same scan line and are adjacent to each other in the first direction.

9. The display device as claimed in claim 8, wherein each row of the organic light emitting diodes includes n number of organic light emitting diodes (n being a positive integer), the number of the data lines being n+1.

10. The display device as claimed in claim 1, wherein the first pixel driving circuit and the second pixel driving circuit are connected to a same data line and are adjacent to each other in the second direction.

11. The display device as claimed in claim 10, wherein each column of the organic light emitting diodes includes m number of organic light emitting diodes (m being a positive integer), the number of the scan lines being m+1.

12. A display device, comprising:

a first pixel driving circuit;

a second pixel driving circuit;

a light emitter to emit light at a first brightness based on a driving current from the first pixel driving circuit in a first frame and to emit light at a second brightness based on a driving current from the second pixel driving circuit in a second frame, wherein the first brightness is different from the second brightness, wherein the light emitter is the only light emitter to which the first pixel driving circuit and the second pixel driving circuit are connected, wherein the light emitter is not to emit light in the first frame and is to emit light at a third brightness in the second frame when the first pixel driving circuit is operating abnormally, the third brightness is greater than the second brightness.

13. The display device as claimed in claim 12, further comprising:

a first switch between the light emitter and the first pixel driving circuit; and a second switch between the light emitter and the second pixel driving circuit, wherein:

in the first frame, the first switch is to be in a first state and the second switch is to be in a second state, and in the second frame, the first switch is to be in the second state and the second switch is to be in the first state.

14. The display device as claimed in claim 13, wherein the first switch is to be turned off in the first frame and the second frame when the first pixel driving circuit is operating abnormally.

15. The display device as claimed in claim 12, wherein the third brightness is twice or more than the second brightness.

16. The display device as claimed in claim 12, further comprising:

a driver to change a level of a data voltage to be applied to the second pixel driving circuit when the first pixel driving circuit is operating abnormally.

17. The display device as claimed in claim 12, wherein the first pixel driving circuit and the second pixel driving circuit are connected to a same scan line and are adjacent to each other.

* * * * *